US006841328B2

(12) United States Patent
Shirose et al.

(10) Patent No.: US 6,841,328 B2
(45) Date of Patent: Jan. 11, 2005

(54) IMAGE FORMING METHOD

(75) Inventors: Meizo Shirose, Tokyo (JP); Hiroshi Yamazaki, Tokyo (JP); Hiroyuki Yamada, Tsukui-gun (JP); Asao Matsushima, Tokyo (JP); Tatsuya Nagase, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/126,244

(22) Filed: Apr. 19, 2002

(65) Prior Publication Data

US 2003/0198879 A1 Oct. 23, 2003

(51) Int. Cl.[7] ..... G03G 13/22
(52) U.S. Cl. ..... 430/124; 430/45
(58) Field of Search ..... 430/124, 45, 110.4, 430/126

(56) References Cited

U.S. PATENT DOCUMENTS

| | | | | |
|---|---|---|---|---|
| 5,329,342 | A | 7/1994 | Shirai et al. | 355/285 |
| 5,830,617 | A | 11/1998 | Koyama et al. | 430/109 |
| 6,051,350 | A * | 4/2000 | Inaba et al. | 430/45 |
| 6,248,494 | B1 | 6/2001 | Yamazaki et al. | 430/110 |
| 6,296,980 | B1 * | 10/2001 | Oshiba et al. | 430/110.3 |
| 6,440,630 | B2 | 8/2002 | Isobe et al. | 430/124 |
| 6,472,117 | B1 | 10/2002 | Kohyama et al. | 430/110.3 |
| 6,497,984 | B2 | 12/2002 | Itami et al. | 430/125 |
| 2001/0004426 | A1 * | 6/2001 | Sato | 399/350 |
| 2003/0031481 | A1 * | 2/2003 | Miho | 399/222 |

FOREIGN PATENT DOCUMENTS

| | | |
|---|---|---|
| JP | 2000-172004 | 6/2000 |
| JP | 2000-214629 | 8/2000 |
| JP | 2000-250259 | 9/2000 |
| JP | 2001-265145 | 9/2001 |
| JP | 2001-296694 | 10/2001 |

* cited by examiner

*Primary Examiner*—John L Goodrow
(74) *Attorney, Agent, or Firm*—Squire, Sanders & Dempsey

(57) ABSTRACT

An image forming method is disclosed. The method comprises the steps of forming a latent image on a latent image carrying member, developing the latent image by a developer containing a toner, transferring the toner image onto an intermediate transfer member, transferring the toner image transferred on the intermediate transfer member onto a image forming support, and fixing the toner image formed on the image forming support, wherein the toner contains a resin and a colorant, and the toner is constituted by toner particles having a variation coefficient of the shape coefficient of not more than 16% and a number variation coefficient of the particle size distribution of not more than 27%.

33 Claims, 10 Drawing Sheets

TONER HAVING NO CORNERS

TONER HAVING CORNERS

TONER HAVING CORNERS

IMAGE FORMING METHOD

FIELD OF THE INVENTION

This invention relates to a toner for developing a static latent image and an image forming method.

BACKGROUND OF THE INVENTION

An image forming method has been known in which a latent image formed on a latent image carrying member is developed by a toner, and the toner image is once transferred onto an intermediate transfer member and then transferred onto an image forming support and fixed. Such the method is different from a usual method in which the toner image formed on the latent image carrying member is directly transferred on the image forming support. In the former method, a toner having a stable charging ability is necessary since the toner image is subjected to plural times of transfer.

On a toner prepared by a usual crashing method, a problem is raised that the color reproducibility of the color image is degraded since the material dispersed in the toner is non-uniformly existed at the crashed surface of the toner particle, accordingly, the surface property of each of the toner particles is difficultly made uniform and the fluctuation of the transfer is tend to be occurred.

Besides, a polymerized toner prepared by a polymerization method has been known. Among the polymerized toner, one prepared by a suspension polymerization method is expected to have a high uniformity of the toner particles since the spherical toner particles each having the uniform surface property can be formed by such the suspension polymerization. However, a problem of degradation of the transferring ability is raised on such the toner since the adhesiveness to the latent image carrying member is made too high in the toner composed of sphere shaped particles.

A toner for developing a static latent image and an image forming method using the toner is required by which an image can be stably formed during a prolonged period by the image forming method using the intermediate transfer member.

SUMMARY OF THE INVENTION

The object of the invention is to provide the toner for developing a static latent image and the image forming method using the toner by which an image can be stably formed during the prolonged period.

The invention is described below.

An image forming method comprising the steps of forming a latent image on a latent image carrying member, developing the latent image by a developer containing a toner, transferring the toner image onto an intermediate transfer member, transferring the toner image transferred on the intermediate transfer member onto a image forming support, and fixing the toner image formed on the image forming support, wherein the toner contains a resin and a colorant, and the toner is constituted by toner particles having a variation coefficient of the shape coefficient of not more than 16% and a number variation coefficient of the particle size distribution of not more than 27%.

An image forming method comprising the steps of forming a latent image on a latent image carrying member, developing the latent image by a developer containing a toner, transferring the toner image onto an intermediate transfer member, transferring the toner image transferred on the intermediate transfer member onto a image forming support, and fixing the toner image formed on the image forming support, wherein the toner contains a resin and a colorant, and the toner is constituted by toner particles having a ratio of particles without corner of not less than 50% and a number variation coefficient of the particle size distribution of not more than 27%.

An image forming method comprising the steps of forming a latent image on a latent image carrying member, developing the latent image by a developer containing a toner, transferring the toner image onto an intermediate transfer member, transferring the toner image transferred on the intermediate transfer member onto a image forming support, and fixing the toner image formed on the image forming support, wherein the toner contains a resin and a colorant, and the toner is constituted by toner particles having a ratio of particles having a shape coefficient of from 1.2 to 1.6 of not less than 65% in number and a variation coefficient of the shape coefficient of not more than 16%.

An image forming method comprising the steps of forming latent image A corresponding to a yellow image on a latent image carrying member, developing the latent image A with a developer containing a yellow toner, transferring the yellow toner image onto an intermediate transfer member, forming latent image B corresponding to a magenta image on the latent image carrying member, developing the latent image B with a developer containing a magenta toner, transferring the magenta toner image onto the intermediate transfer member, forming latent image C corresponding to a cyan image on the latent image carrying member, developing the latent image C with a developer containing a cyan toner, transferring the cyan toner image onto the intermediate transfer member, forming latent image D corresponding to a black image on the latent image carrying member, developing the latent image D with a developer containing a black toner, transferring the black toner image onto the intermediate transfer member, transferring the yellow toner image, the magenta toner image, the cyan toner image and the black toner image formed on the intermediate transfer member onto an image forming support, and fixing the toner image formed on the image forming support, wherein a shape coefficient Ky, a variation coefficient of the shape coefficient Kσy, a number average of particle diameter Dy and a variation coefficient of the number of the number size distribution Dσy of the yellow toner; a shape coefficient Km, a variation coefficient of the shape coefficient Kσm, a number average of particle diameter Dm and a variation coefficient of the number of the number size distribution Dσm of the magenta toner; a shape coefficient Kc, a variation coefficient of the shape coefficient Kσc, a number average of particle diameter Dc and a variation coefficient of the number in the number size distribution Dσc of the cyan toner, and a shape coefficient Kb, a variation coefficient of the shape coefficient Kσb, a number average of particle diameter Db and a variation coefficient of the number of the number size distribution Dσb of the black toner, are represented by the foregoing formulas 1 through 4.

DETAILED DESCRIPTION OF THE INVENTION

Figure 1:
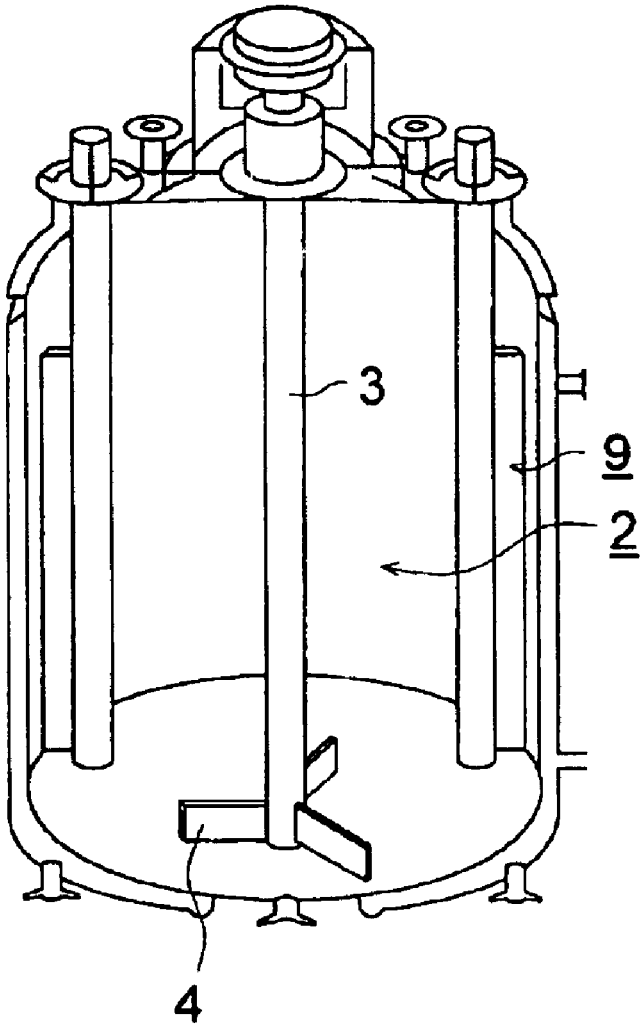
FIG. 1 is a drawing describing a reaction apparatus having a single step stirring propeller.

It has been found by the inventors that the image formation can be stabilized by controlling the physical parameters of the toner particle to the later-mentioned specific values even in the image forming method including an intermediate transfer step using a toner having a high mold-releasing ability.

Toner for developing electrostatic latent image according to the invention is described.

It has been found by the inventors that the foregoing problems can be solved by the use of the toner having a variation coefficient of the shape coefficient of not more than 16% and a number variation coefficient of the particle diameter distribution of not more than 27%.

It is preferable that the toner content of particles having no corner is not less than 50% and a number variation coefficient of the particle diameter distribution in number is not more than 27%.

The toner of the invention preferably contains the toner particles having a shape coefficient within the range of from 1.2 to 1.6 in a ratio of not less than 65% in number and a variation coefficient of the shape coefficient of not more than 16%.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

In one of the embodiment of the invention the toner preferably has a number ratio of toner particles having a shape coefficient of 1.0 to 1.6 and is at least 65 percent, and more preferably 70 percent or more, and further number ratio of toner particles having a shape coefficient of 1.2 to 1.6 and is at least 65 percent, and particularly preferably 70 percent or more.

According to such characteristics as shape coefficient and number ratio of toner particles high toner filling density in a toner layer which is transferred to an intermediate transfer material is obtained, fluctuation of transfer characteristics of toner between different colors at the second image transfer process to an image forming support is reduced, and therefore, a good transfer characteristics is obtained. Further variation of adhesion property in each color is lowered and therefore a color image can be obtained stably since the toner particle is not easily crashed, stain on the charging member is reduced and charging characteristics of the toner becomes stable.

The polymerized toner of the present invention is that the number ratio of toner particles in the range of said shape coefficient of 1.2 to 1.6 is preferably at least 65 percent and is more preferably at least 70 percent.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The toner obtained by polymerization method is preferable in view of simple preparation and excellent in uniform surface property comparing with the pulverized toner.

Variation Coefficient the Shape Coefficient

The variation coefficient the shape coefficient of the polymerized toner is calculated using the formula described below:

$$\text{Variation coefficient}=(S1/K)\times 100(\text{in percent})$$

wherein S1 represents the standard deviation of the shape coefficient of 100 toner particles and K represents the average of said shape coefficient.

The variation coefficient is preferably not more than 16%, and more preferably not more than 14% in the present invention. Gaps between toner particles in the toner layer are reduced, the transfer characteristics is minimized at the second transfer to the image forming support and therefore good image transfer characteristics is obtained. Further image characteristics is improved because sharp charging distribution is obtained.

In order to control said shape coefficient of toner uniformly as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution. The number variation coefficient in the number particle distribution of toner is calculated employing the formula described below:

$$\text{Number variation coefficient}=(S2/D_n)\times 100(\text{in percent})$$

wherein S2 represents the standard deviation in the number particle size distribution and $D_n$ represents the number average particle diameter (in $\mu$m).

The number variation coefficient of the toner of the present invention is not more than, preferably, 27 percent, and is more preferably not more than 25 percent. By adjusting the number variation coefficient to not more than 27 percent, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The number ratio of toner particles having no corners is set preferably at least 50 percent, and or more preferably at least 70 percent. By adjusting the number ratio of toner particles having no corner as above, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency since number of toners which are prone to be wore or crashed and have charge concentration portions reduces.

Figure 11:
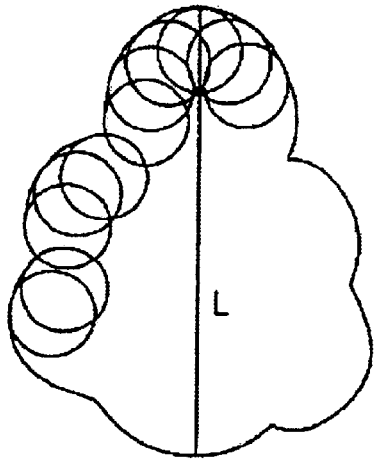
FIG. 11*a* shows a projection image of a toner particle without a corner and FIGS. 11*b* and 11*c* each show a projection image of @article with a corner.
Figure 11:
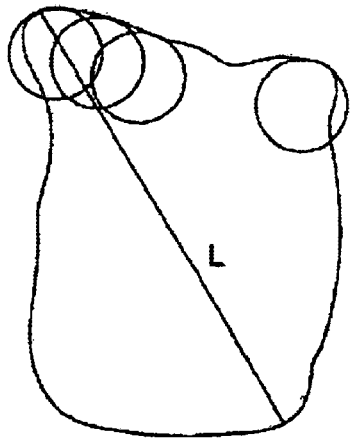
Figure 11:
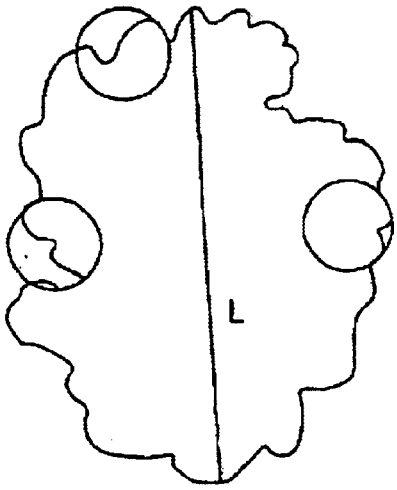

The toner particles of the present invention, which substantially have no corners, as described herein, mean those having no projection to which charges are concentrated or which tend to be worn down by stress. Namely, as shown in FIG. 11(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 11(*b*) and 11(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

In the invention, the color reproducibility is enhanced when the toner particles are uniform in the shape thereof in each of the yellow, magenta, cyan and black toners. Accordingly, it is preferable that the toners satisfy the following conditions.

Formula 1

$$0 \leqq R1 \leqq 0.2$$

wherein R1={(The maximum value of Ky, Km, Kc and Kb)−(The minimum value of Ky, Km, Kc and Kb)}/(The maximum value of Ky, Km, Kc and Kb)

Formula 2

$$0 \leqq R2 \leqq 0.30$$

wherein R2={(The maximum value of Kσy through Kσb)−(The minimum value of Kσy through Kσb)}/(The maximum value of Kσy through Kσb)

Formula 3

$$0 \leqq R3 \leqq 0.15$$

wherein R3={(The maximum value of Kσy through Kσb)−(The minimum value of Dy through Db)}/(The maximum value of Dy through Db)

Formula 4

$$0 \leqq R4 \leqq 0.30$$

wherein R4={(The maximum value of Dσy through Dσb)−(The minimum value of Dσy through Dσb)}/(The maximum value of Dσy through Dσb)

This means that a shape coefficient Ky, a variation coefficient of the shape coefficient Kσy, a number average of particle diameter Dy and a variation coefficient of the number of the particle size distribution Dσy of the yellow toner; a shape coefficient Km, a variation coefficient of the shape coefficient Kσm, a number average of particle diameter Dm in a variation coefficient of the number of the particle size distribution Dσm of the magenta toner; a shape coefficient Kc, a variation coefficient of the shape coefficient Kσc, a number average of particle diameter Dc and variation coefficient of the number of the particle size distribution Dσc of the cyan toner, and a shape coefficient Kb, a variation coefficient of the shape coefficient Kσb, a number average of particle diameter Db and a variation coefficient of the number of the particle size distribution Dσb of the black toner, are represented by the foregoing formulas 1 through 4.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur.

Diameter of Toner Particles

The diameter of the toner particles of the present invention is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 μm, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

Measurement Conditions (1) Aperture: 100 μm (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

<Comparing with a Conventional Toner>

The toner according to the invention can be clearly distinguished from the know toner as to (a) the ratio of the toner particles having a shape coefficient within the range of from 1.2 to 1.6 (not less than 65% in number in the toner of the invention), (b) the variation coefficient of the shape coefficient (not more than 16% in the toner of the invention), (c) the ratio of the particles having no corner (not less than 50% in number in the toner of the invention), and (d) the number variation coefficient of the particle diameter distribution in number (not more than 27% in the toner of the invention).

The values described in (a) to (d), regarding the toner according to the invention, of the usually known toners are described below. The values are different accompanied with the producing method of the toner.

Toner by Pulverizing Method

In the case of the usually known toner produced by a pulverizing method, the ratio of the particles having a shape coefficient within the range of from 1.2 to 1.6 is approximately 60% in number. The variation coefficient of the shape coefficient of such the toner is about 20%. In the toner by the pulverizing method, the ratio of the toner particles having no corner is not more than 30% in number since the particle size is made small by repeating the crushing accordingly the corner is formed on many toner particles. Therefore, a treatment for making sphere the shape of the toner particle by heating is necessary for controlling the shape coefficient to obtain a toner particles each uniformly has a rounded shape without corner. The number variation coefficient of the particle diameter distribution in number is about 30% when the classifying after crushing is performed only once. The classifying operation has to be repeated to obtain the number variation coefficient of not more than 27%.

Toner Produced by the Suspension Polymerization Method

Toner particles each having a true sphere shape can be obtained since the polymerization is performed in a layer flowing. For example, the ratio of the particles having a shape coefficient within the range of from 1.2 to 1.6 is approximately 20% in number, the variation coefficient of the shape coefficient is about 18%, and the ratio of the particle having no corner is about 85% in number in the toner described in Japanese Patent Publication Open to Public Inspection, hereinafter referred to as JP O.P.I., No. 63-186253. In the production process of the toner, large oil drop of the polymerizable monomer is make small to the size of the toner particle by repeating the mechanical tearing. Therefore, the distribution of the oil drop size is spread and the variation coefficient of number is as large as about 32%, and the classifying process is necessary to lower the variation coefficient of number.

In the polymerization toner produced by association or melt-adhesion of the resin particles, for example, the toner described in JP O.P.I. No. 63-186253, the ratio of the particles having a shape coefficient within the range of from 1.2 to 1.6 is approximately 60% in number, the variation coefficient of the shape coefficient is about 18%, and the ratio of the particle having no corner is about 44% in number. The distribution of diameter is wide and the variation coefficient of number is 30%. A classifying process is necessary to lower the variation coefficient of number.

Preparation of Toner

The toner preferably employed in the invention is one obtained by polymerization of at least polymerizable monomer in an aqueous medium and by coagulation of at least resin particle in an aqueous medium. Examples of the method to prepare the toner will be described.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

The water based medium as described in the present invention means one in which at least 50 percent, by weight of water, is incorporated. A method for preparing said toner may includes one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The concentration of coagulant may be not less than the critical coagulation concentration. However, the amount of the added coagulant is preferably at least 1.2 times of the critical coagulation concentration, and more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like. Example of the ester type wax includes carnauba wax, candelilla wax and microcrystalline wax.

The fixability improving agents can be incorporated in the toner particle in such a way that the releasing agent and the resin particles are subjected to salting out/fusing as well as colored particles, or the releasing agent is dissolved in a monomer to form resin particles and then the monomer is polymerized.

Employed as charge control agents may also be various types of those which are known in the art and can be dispersed in water. Specifically listed are nigrosine dyes, metal salts of naphthenic acid or higher fatty acids, alkoxylated amines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Preparation Apparatus

FIG. 1 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
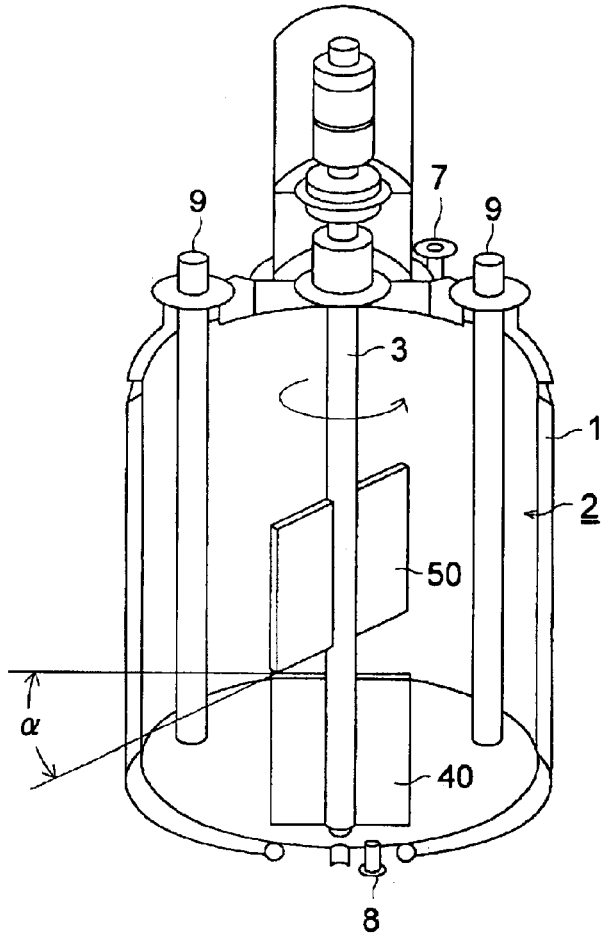
FIG. 2 is an oblique view of an example of reaction apparatus having a stirring propeller to be preferably used.
Figure 3:
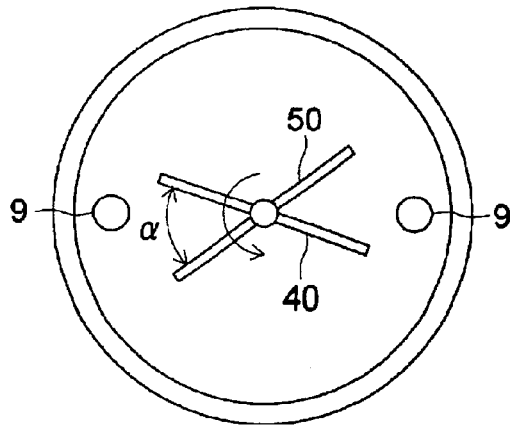
FIG. 3 is a cross section of the apparatus shown in FIG. 2.

FIGS. 2 and 3 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

In FIGS. 2 and 3, arrows show the rotation direction, reference numeral 7 is upper material charging inlet, 8 is a lower material charging inlet, and 9 is a turbulent flow forming member which makes stirring more effective.

Figure 10:
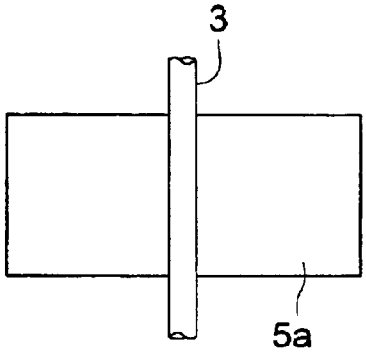
FIG. 10 is a schematic drawing showing a concrete example of the shape of a stirring propeller.
Figure 10:
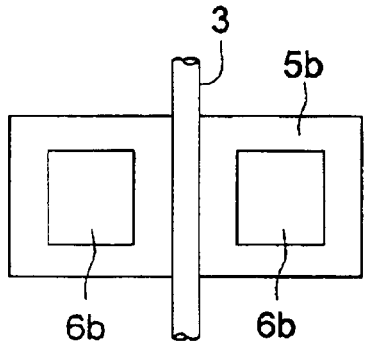
Figure 10:
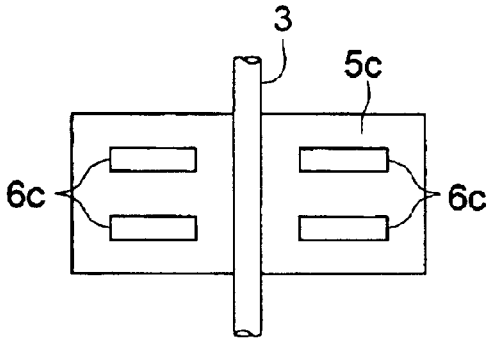
Figure 10:
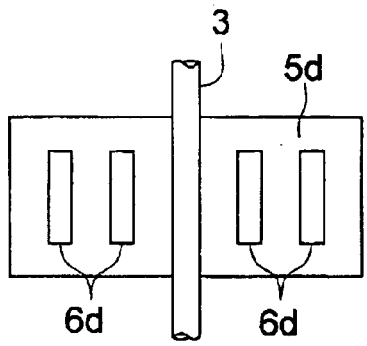

Herein, the shape of the stirring blades is not particularly limited, but employed may be those which are in square plate shape, blades in which a part of them is cut off, blades having at least one opening in the central area, having a so-called slit, and the like. FIGS. 10(*a*) to 12(*d*) describes specific examples of the shape of said blades. Stirring blade 5*a* shown in FIG. 10(*a*) has no central opening; stirring blade 5*b* shown in FIG. 10(*b*) has large central opening areas 6*b*; stirring blade 5*c* shown in FIG. 10(*c*) has rectangular openings 6*c* (slits); and stirring blade 5*d* shown in FIG. 10(*d*) has oblong openings 6*d* shown in FIG. 10(*d*). Further, when stirring blades of a three-level configuration are installed, openings which are formed at the upper level stirring blade and the openings which are installed in the lower level may be different or the same.

FIGS. 4 through 8 each show a perspective view of a specific example of a reaction apparatus equipped with stirring blades which may be preferably employed. In FIGS. 4 through 8, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 4:
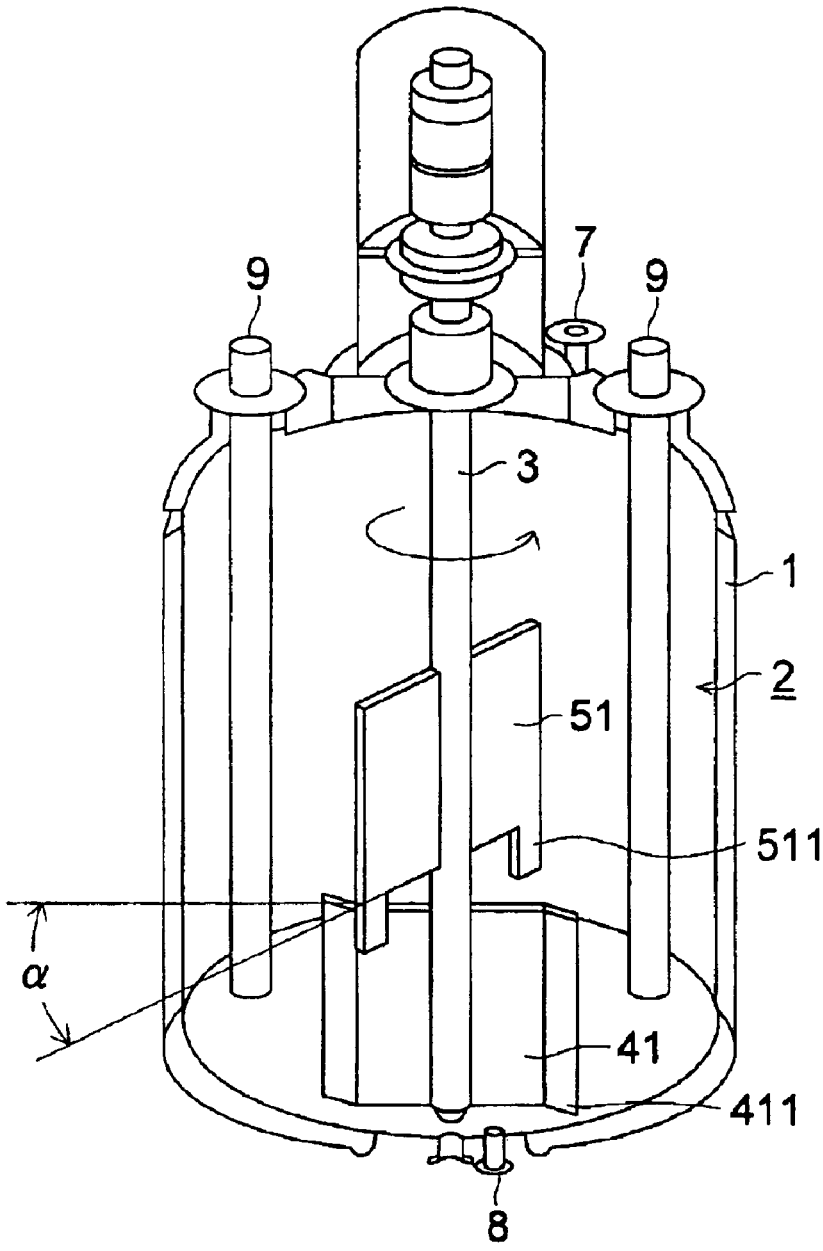
FIG. 4 is an oblique view of a concrete example of reaction apparatus having a stirring propeller to be preferably used.

In the reaction apparatus shown in FIG. 4, folded parts 411 are formed on stirring blade 42 and fins 511 (projections) are formed on stirring blade 51.

Further, when said folded sections are formed, the folded angle is preferably between 5 and 45 degrees.

Figure 5:
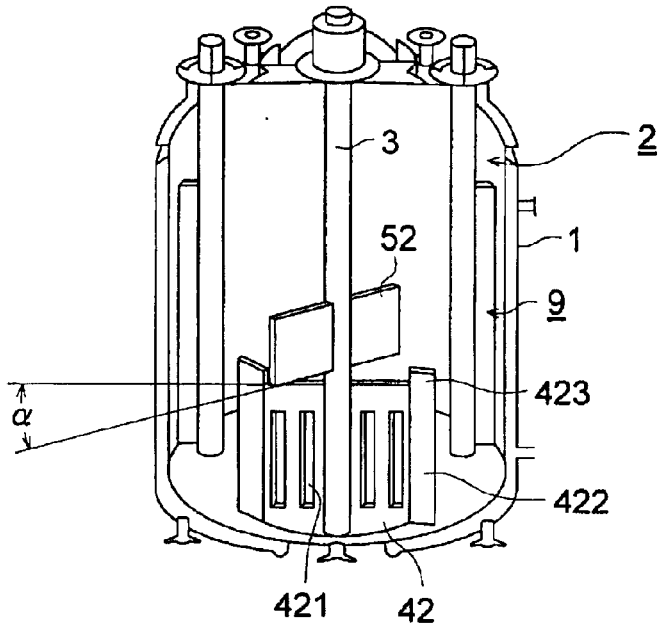
FIG. 5 is an oblique view of a concrete example of reaction apparatus having a stirring propeller to be preferably used.

In stirring blade 42 which constitutes the reaction apparatus shown in FIG. 5, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 2.

Figure 6:
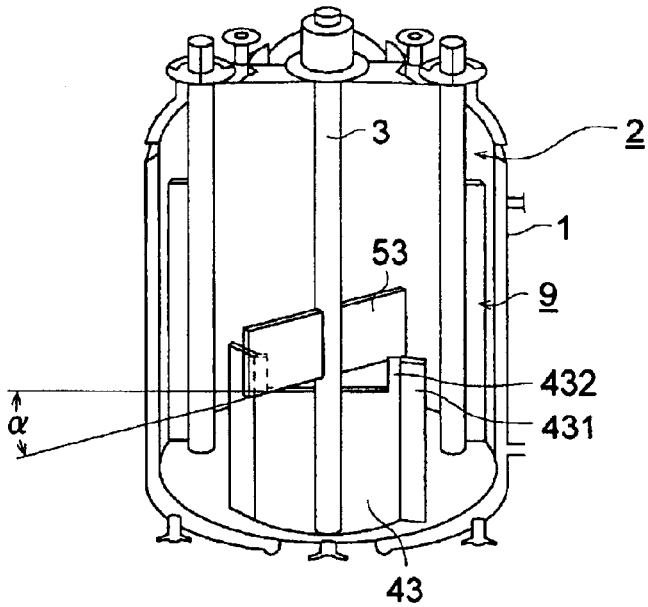
FIG. 6 is an oblique view of a concrete example of reaction apparatus having a stirring propeller to be preferably used.

In stirring blade 43 which constitutes part of the reaction apparatus shown in FIG. 6, folded section 431 as well as fin 432 is formed.

Further, stirring blade 53, which constitutes part of said reaction apparatus, has the same shape as stirring blade 50 which constitutes part of the reaction apparatus shown in FIG. 2.

Figure 7:
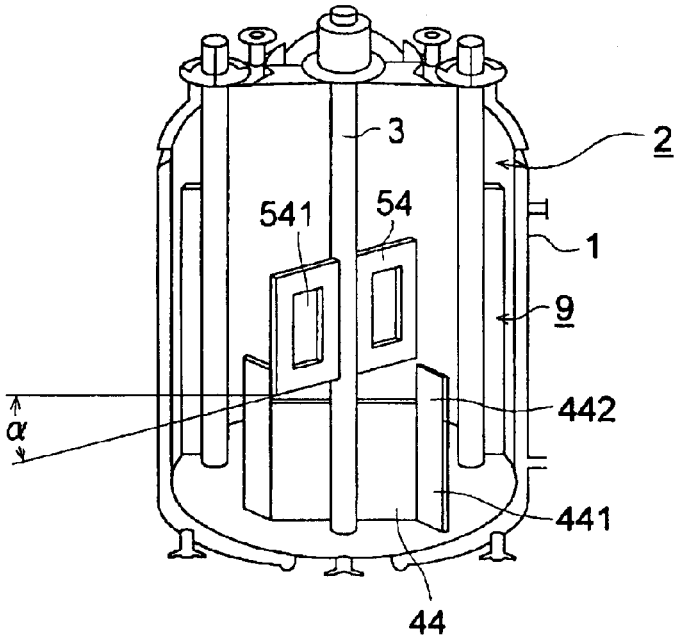
FIG. 7 is an oblique view of a concrete example of reaction apparatus having a stirring propeller to be preferably used.

In stirring blade 44 which constitutes part of the reaction apparatus shown in FIG. 7, folded section 441 as well as fin 442 is formed.

Further, in the stirring blade 54 which constitutes part of said reaction apparatus, openings 541 are formed in the center of the blade.

Figure 8:
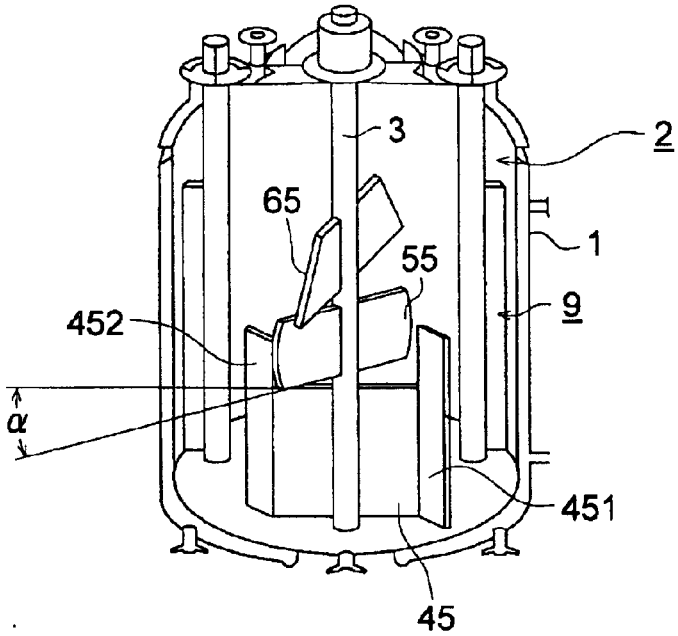
FIG. 8 is an oblique view of a concrete example of reaction apparatus having a stirring propeller to be preferably used.

In the reaction apparatus shown in FIG. 8, provided are stirring blades at three-level comprised of stirring blade 45

(at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 9:
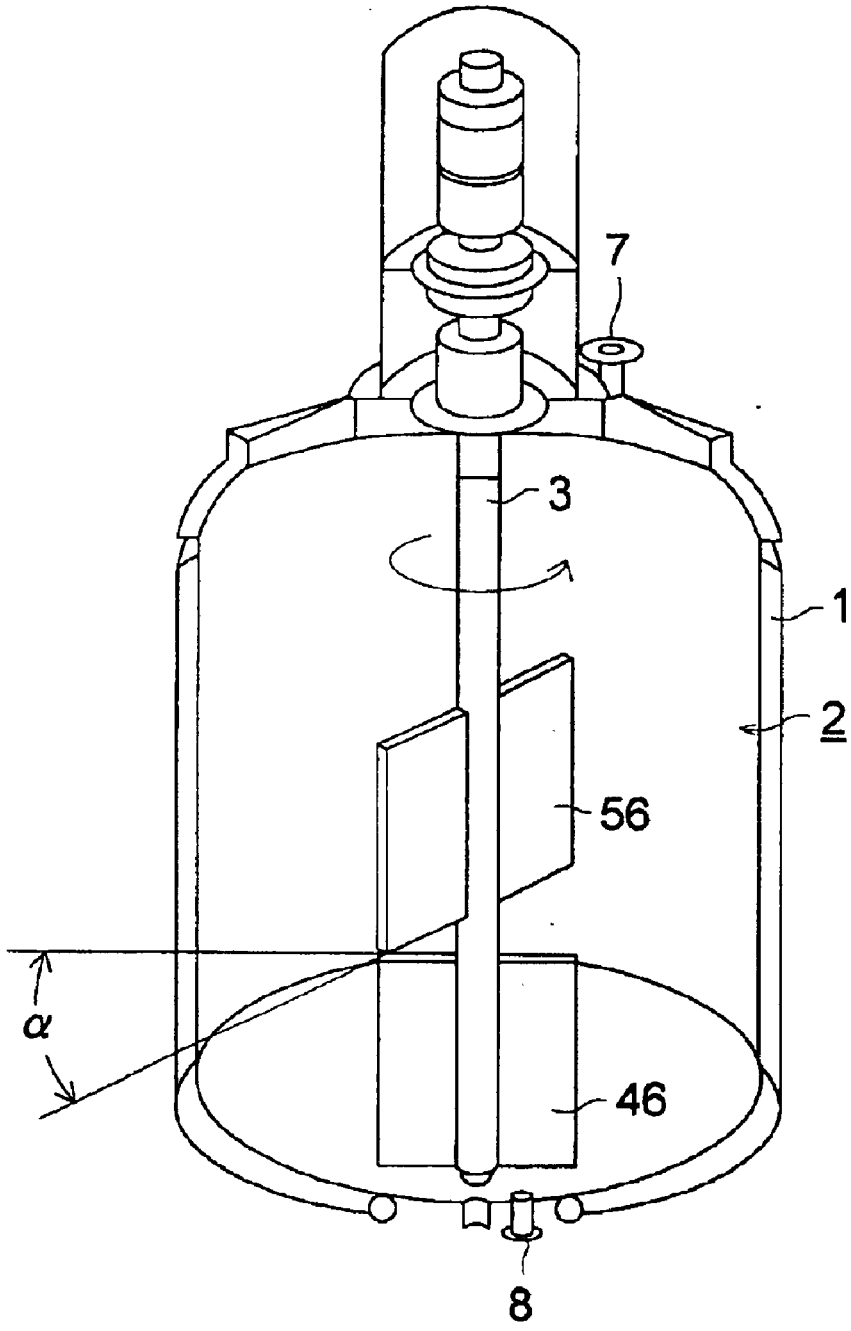
FIG. 9 is an oblique view of an example of reaction apparatus to be used for forming a layer current.

FIG. 9 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56 shown in FIG. 9, has the same shape as well as the crossed axis angle of stirring blade 40, as well as stirring blade 50 which constitutes part of the reaction apparatus shown in FIG. 4. In FIG. 9, reference numeral 1 is a heat exchange jacket, 2 is a stirring tank, 3 is a rotation shaft, 7 is an upper material charging inlet, and 8 is a lower material charging inlet.

Apparatuses, which are employed to form a laminar flow, are not limited to ones shown in FIG. 9.

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the Toner Production Example employing the polymerization method in which resinous particles are associated or fused, can be the same stirring blades and stirring tank which are employed in said suspension polymerization in which the laminar flow is formed, and for example, it is possible to employ the apparatus shown in FIG. 9. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 10(*a*), which are formed of a continuous plane are preferable, and those having a curved plane may also be employed.

The toner of the present invention may be employed as either a single component developer by incorporating, for example, a magnetic material in a toner particle or a two-component developer by mixing with a carrier. It is preferably employed as a two-component developer.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m. The volume average particle diameter of said carrier is typically measured employing a laser diffraction type particle distribution meter, HELOS (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

Figure 12:
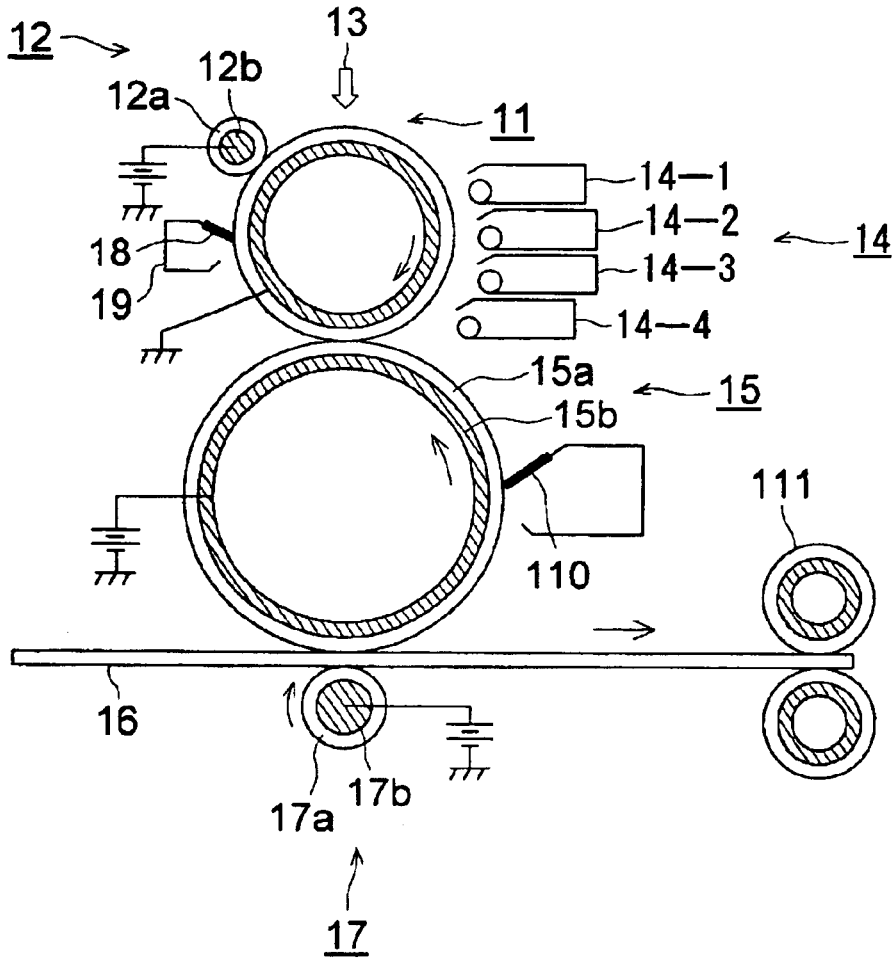
FIG. 12 shows an example of developing device according to a non-contacting developing method.

The image forming method and the image forming apparatus to be used in the method are described with FIG. 12.

In the apparatus shown in FIG. 12, a developer containing a cyan toner, a developer containing a magenta toner, a developer containing a yellow toner and a developer containing a black toner are each charged in the developing devices 14-1, 14-2, 14-3 and 14-4, respectively. The static latent images formed on a photoreceptor 11 are developed by a magnetic brush method or a non-magnetic single-component developing method to form toner images of each of the colors. The photoreceptor 11 is a photoreceptor drum or a photoreceptor belt having a layer of a photoconductive insulation substance such as a-Se, CdS, $ZnO_2$, OPC and a-Si. The photoreceptor 11 is rotated in the direction of the arrow in the drawing by a driving member not shown in the drawing.

A photoreceptor having an amorphous silicone layer or an organic photosensitive layer is preferably used for the photoreceptor 11. The organic photosensitive layer may be either a single layer type containing a charge generation substance and a charge transport substance in the same layer or a function separation layer type composed of a charge transport layer and a charge generation layer. A piled layer type photosensitive layer having a structure in which a charge generating layer and a charge transport layer are piled on an electroconductive substrate in this order is an example of preferable photosensitive layer.

A polycarbonate resin, a polyester resin and an acryl resin are particularly preferable in the transferring and cleaning ability and the unsatisfied cleaning, adhesion of the toner to the photoreceptor and the filming of an exterior additive are difficultly occurred.

In the charging process relating to the image forming method of the invention, either a non-contacting method using a corona discharging device in which the charging device is not contacted to the photoreceptor 11 or a contacting method using a roller may be used. The contacting method shown in FIG. 12 is preferably used for uniformly charging, simplification of the apparatus and inhibiting of ozone generation.

The charging roller 12 is basically composed of a metal shaft 12*b* at the central portion and an electroconductive elastic layer 12*a* constituting the circumference of the roller. The charging roller 12 is contacted to the surface of the photoreceptor 11 with a pressure and rotated accompanied with the rotation of the photoreceptor 11.

The following conditions are preferred when the charging roller is used. The pressure applied for contacting the roller is from 4.9 to 490 N/m (5 to 500 g/cm), an alternative current voltage of from 0.5 to 5 kVpp with a frequency of from 50 to 5 kHz and a direct current voltage of from ±0.2 to ±1.5 kV when the direct current voltage is overlapped with the alternative current voltage, and a direct current voltage of from ±0.2 to ±5 kV when the direct current is applied.

A charging method using a charging blade or that using an electroconductive brush may be used other than the above-mentioned method. Such the contact charging means have merits that no high voltage is necessary and the generation of ozone is inhibited. An electroconductive rubber is preferred for the material of the charging roller and the charging blade as the charging means. A mold-releasing layer may be provided on the surface of such the charging means. As the mold-releasing layer, a nylon resin, PVDF (vinylidene polyfluoride) and PVDC (vinylidene polychloride) are usable.

The toner image formed on the photoreceptor is transferred onto the intermediate transfer member 15 to which a voltage, for instance from ±0.1 to ±5 kV is applied.

The intermediate transfer member 15 is composed of a pipe-shaped electroconductive metal central shaft 15*b* and a medium resistive elastic layer 15*a* formed at the circumference of the shaft. The metal central shaft may be a plastic pipe on which a electroconductive paling layer is provided. The elastic layer having a medium electroresistivity is a solid or porous layer composed of a elastic substance such as silicone rubber, chloroprene rubber, urethane rubber, EPDM (ternary copolymer of ethylene-propylene-diene) in which a substance for giving an electro conductivity such as carbon black, zinc oxide, tin oxide and silicon carbide is dispersed so as to control the electroresistivity (volume resistivity) to a medium resistively of from $10^5$ to $10^{11}$ Ω·cm.

The intermediate transfer member 15 is held in parallel with the photoreceptor in the direction of the shaft thereof so as to contact to the lower portion of the photoreceptor surface. The intermediate transfer member 15 is counter-clockwise rotated as shown by the arrow at a circumference speed the same as that of the photoreceptor 11. The first color toner image formed and carried on the photoreceptor 11 is intermediately transferred onto the surface of the intermediate transfer member 15 at the time of passing through the nipping zone at which the photoreceptor 11 and the intermediate transfer member 15 are contacted to each other by the electric field generated at the nipping zone by the transfer bias applied to the intermediate transfer member 15. The surface of the intermediate transfer member 15 is cleaned after transfer of the image to the image forming support by a releasable cleaning means 101, according to necessity. The cleaning means 101 is released from the intermediate transfer member surface when the toner image is existed on the intermediate transfer member 15 so as not to disarrange the toner image.

A transfer means is arranged in parallel with the intermediate transfer member 15 in the direction of the shaft thereof so as to contact to the lower portion of the intermediate transfer member 15. The transfer member is, for instance, a transfer roller 17 which is clockwise rotated at a circumference speed the same as that of the intermediate transfer member 15 as shown by the arrow in the drawing. The transfer roller 17 may be either arranged so as to directly contacted to the intermediate transfer member 15 or to contact a belt between the intermediate transfer member 15 and the transfer roller 17. The transfer roller 17 is basically composed of a central metal shaft 17*b* and an electroconductive elastic layer 17*a* constituting the circumference of the roller.

A usual material can be used for the intermediate transfer member and the transfer roller to be used in the invention. In the invention, the voltage to be applied to the transfer roller can be reduced by setting the intrinsic volume resistively of the elastic layer of the transfer roller so as to be lower than that of the elastic layer of the intermediate transfer member. As a result of that, the toner image can be suitably formed on the image forming support and the winding of the image forming support around the intermediate transfer member can be prevented.

It is preferable that the intrinsic volume resistively of the elastic layer of the intermediate transfer member is 10 times or more of that of the elastic layer of the transfer roller. The hardness of the intermediate transfer member and the transfer roller can be defined according to JIS K-6301. The intermediate member to be used in the invention is preferably constituted by a elastic layer having a hardness of from 10 to 40°, and the hardness of the elastic layer of the transfer roller is preferably from 41 to 80°, higher than that of the intermediate transfer member, for preventing the winding of the image forming support around the intermediate transfer member. When the relation of the hardness of the intermediate transfer member and that of the transfer roller is reversed, a concave is formed on the transfer roller and the winding of the image forming support around the intermediate transfer member is tend to be occurred.

The transfer roller is rotated at a circumference speed the same as or different from that of the intermediate transfer member 15. The image forming support 16 is supplied between the intermediate transfer member 15 and the transfer roller 17 and a transfer bias having a polarity opposite to that of the triboelectricity of the toner image is applied from a bias applying means to the transfer roller 17, thus the toner image on the intermediate transfer member 15 is transferred onto the upper surface of the image forming support 16. As the material of the transfer rotating member, that the same as for the charging roller can be used. As the processing conditions, a contacting pressure of from 4.9 to 490 N/m (5 to 500 g/cm) and a direct current bias of from ±0.2 to ±10 kV are preferable.

The electroconductive elastic layer 17*b* of the transfer roller 17 is made from an elastic substance such as polyurethane and a ternary polymer of ethylene-propylene-diene (EPDM), in which an electroconductive substance such as carbon is dispersed, having a volume electroresistivity of approximately from $10^6$ to $10^{10}$ Ω·cm. A bias voltage is applied to the central metal shaft 17*a* from the constant voltage power source. As the bias condition, a voltage from ±0.2 to ±10 kV is preferable.

Thereafter, the image forming support 16 is introduced into a fixing device 111 basically constituted by a heating roller and a pressure roller contacted to the heating roller with pressure. The toner image is fixed onto the image forming support by heat and pressure by passing between the heating roller and the pressure roller. A method for fixing the image by a heater through a film may be used.

The fixing method preferably used in the invention includes a method so-called as a contact-heating method. The contact-heating method includes a heating roller method and a heat-pressure fixing method particularly a pressure-contact-heating fixing method in which the fixing is carried out by a rotatable pressure member including a fixed heater.

Figure 13:
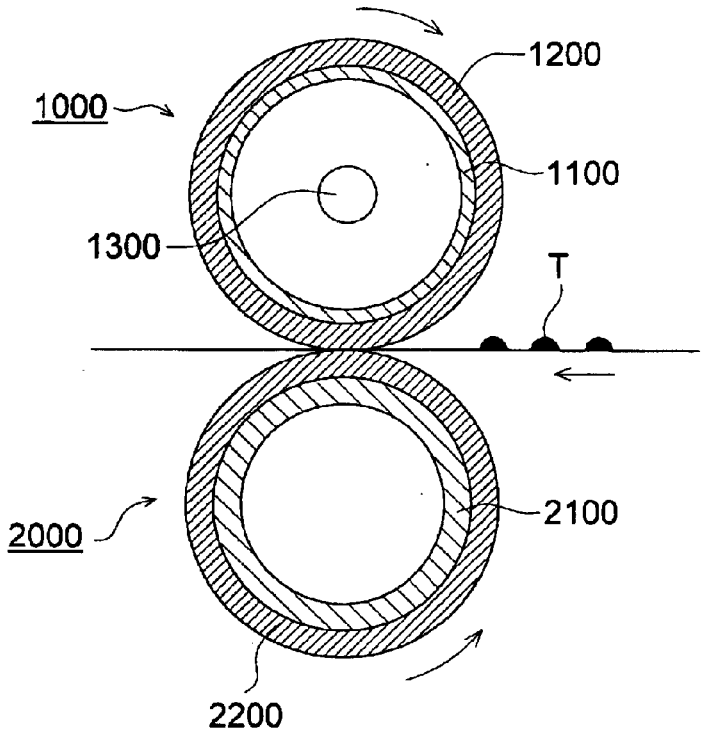
FIG. 13 shows a cross section of an example of fixing device to be used in the invention.

FIG. 13 shows a cross-section of an example of the fixing device to be used in the invention. The fixing device shown in FIG. 13 has a heating roller 1000 and a pressure roller 2000 contacted to the heating roller by pressure. In FIG. 13, T is the toner image formed on a recording member or an image support typically a paper sheet.

The heating roller 1000 is composed of a metal shaft 1100 and a cover layer 1200 formed by silicone rubber and includes a heating member 1300 composed of a linear heater. The surface of the heating roller is preferably covered with a layer or a tube of a polymer such as tetrafluoroethylene and polytetrafluoroethylene-perfluoroalkoxyvinyl ether copolymer. The thickness of such the polymer is from 10 to 500 μm, preferably from 20 to 200 μm.

The metal central shaft 1100 is composed of a metal or an alloy thereof and the internal diameter of the shaft is preferably from 10 to 70 mm. As the material of the shaft, for example, iron, aluminum and copper and an alloy thereof are usable even though there is no limitation on the material.

The thickness of the metal shaft is preferably from 0.1 to 2 mm, which is decided considering the balance of the requirement of the energy saving by thinning and the strength depending on the material. For example, it is preferable that the thickness of the shaft of aluminum is controlled to 0.8 mm for obtaining strength the same as that of the shaft made from iron with a thickness of 0.75 mm.

Examples of the silicone rubber constituting the cover layer 1200 include a silicone rubber such as LTV, RTV and HTV and a sponge thereof.

The thickness of the cover layer 1200 is preferably from 0.1 to 30 mm, more preferably from 0.1 to 20 mm. When the thickness is less than 0.1 mm, the width of nipping cannot be made large and the effect of soft fixing is insufficient.

A halogen heater can be suitably used as the heating member 1300. Plural, not only one, heating members may used as shown in FIG. 13 so that the heating portion can be varied according to the size or width of the paper to be passed. In the heating roller 1500 shown in FIG. 14, a halogen heater 1600A for heating the central portion of the roller and halogen heaters 1600B and 1600C for heating the each end portions of the roller are arranged.

Figure 14:
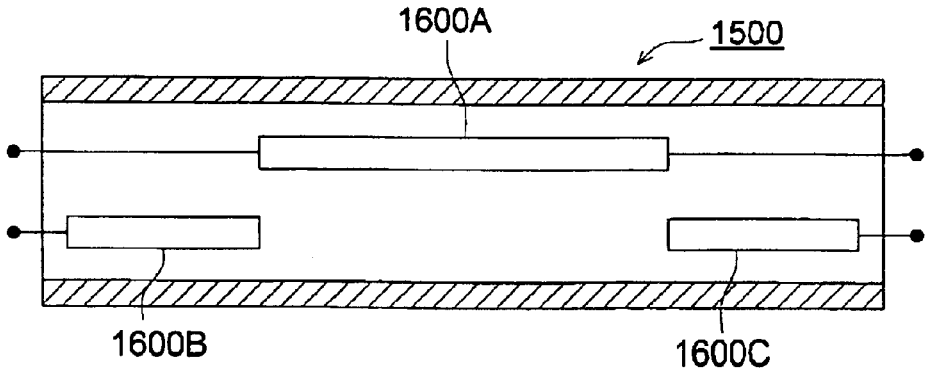
FIG. 14 shows a heat distribution pattern in the heating roller of the fixing device to be used in the invention.

In the heating roller 1500 shown in FIG. 14, electric current is applied only to the heater 1600A when a narrow width paper sheet is passed and electric current is applied further to the heaters 1600B and 1600C when a wide paper sheet is passed.

In FIG. 13, a pressure roller 2000 is composed of a metal shaft 2100 and a cover layer of rubber 2200 formed on the surface of the shaft. Urethane rubber and silicone rubber, preferably a heat resistive silicone rubber, may be used for the cover layer even though there is no specific limitation on the rubber of the cover layer. As the silicone rubber, materials the same as those usable in the cover layer 12 can be used.

Aluminum, iron and copper and an alloy thereof may be used as the material of the metal shaft 2100 even though there is no limitation thereon.

The thickness of the cover layer 2200 is from 0.1 to 30 mm, preferably from 0.1 to 20 mm. When the thickness is less than 0.1 mm, the width of nipping cannot be made large and the effect of soft fixing is insufficient.

The Ascar hardness of the silicone rubber or rubber constituting the cover layers 1200 and 2200 is preferably less than 70°, more preferably less than 60°, and a silicone rubber sponge is preferable.

The contacting load (the total load) applied between the heating roller 1000 and the pressure roller 2000 is usually from 40 to 350N, preferably from 50 to 300N, more preferably from 50 to 250N. The contacting load is decided considering the strength of the heating roller 1000 or the thickness of the metal shaft. For instance, the load of less than 250N is preferable when the heating roller has an iron shaft having the thickness of 0.3 mm.

The nip width is preferably from 4 to 10 mm from the viewpoint of the anti-off-set property and the fixing ability. The surface pressure of the nip is preferably from 0.6 to $1.5\times10^5$ Pa.

In an example of the fixing condition of the fixing device shown in FIG. 13, the fixing temperature or the surface temperature of the heating roller 1000 is from 150 to 210° C. and the line speed of fixing is from 80 to 640 mm/sec.

A cleaning means for the fixing device may be provided in the fixing device to be used in the invention according to necessity. In such the case, a cleaning method can be used, in which silicone oil is supplied to the upper roller of the fixing device by a pad, a roller or a web each immersed with the silicone oil.

As the silicone oil having a high heat resistively such as polydimethylsilicone and polydiphenylsilicone is used. One having a viscosity of from 1 to 100 Pa·s at 20° C. is preferably used since the flowing amount of the oil is made to large at the use when the viscosity of the oil is excessively low.

EXAMPLES

The present invention will now be detailed with reference to examples.

Toner Production Example 1

Example of Emulsion Polymerization Method

Added to 10.0 liters of pure water was 0.90 kg of sodium n-dodecylsulfate, and was subsequently dissolved. Gradually added to the resulting solution were 1.20 kg of Regal 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 238 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.70 kg of n-butyl acrylate, 1.14 kg of methacrylic acid, and 550 g of t-dodecylmercaptan was added dropwise. After said dropwise addition, the resulting mixture was heated to 80±1° C. and stirred for 6 hours while maintaining said temperature. Subsequently, the temperature was lowered to no more than 40° C. and stirring was stopped. The resulting products were filtered employing a pole filter and the resulting filtrate was designated as "Latex (1)-A".

The resinous particles in said Latex (1)-A exhibited a glass transition temperature of 58° C. and a softening point of 119° C., a weight average molecular weight of 13,500 regarding the molecular weight distribution, and a weight average particle diameter of 115 nm.

Further, a solution prepared by dissolving 0.055 kg of sodium dodecylbenzenesulfonate in 4.0 liters of deionized water was designated as "Anionic Surface Active Agent Solution D".

Further, a solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200 g of potassium persulfate (manufactured by Kanto Kagaku Co.) in 12.0 liters of deionized water was designated as "Initiator Solution F".

Charged into a 100 liter GL reaction vessel fitted with a thermal sensor, a cooling pipe, a nitrogen gas inlet, and a comb shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred.

Subsequently, 44.0 liters of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.0 g of t-dodecylmercaptan was added dropwise. After said dropwise addition, the resulting mixture was maintained at 72±2° C. and stirred for 6 hours while maintaining said temperature. Subsequently, the temperature was raised to 80±2° C., and stirring was carried out for 12 more hours while controlling the temperature within said range. The temperature was then lowered to no more than 40° C., and stirring was stopped. The resulting products were filtered employing a pole filter and the resulting filtrate was designated as "Latex (1)-B".

The resinous particles in said Latex (1)-B exhibited a glass transition temperature of 58° C. and a softening point of 133° C., a weight average molecular weight of 245,000 regarding the molecular weight distribution, and a weight average particle diameter of 110 nm.

A solution prepared by dissolving 5.36 g of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel (the reaction apparatus constituted as shown in FIG. 9, having a crossed axes angle $\alpha$ of 25 degrees), fitted with a thermal sensor, a cooling pipe, a nitrogen gas inlet, a particle diameter and shape monitoring device, were 20.0 kg of Latex (1)-A and 5.2 kg of Latex (1)-B as prepared above, 0.4 kg of Colorant Dispersion 1, and 20.0 kg of deionized water, and the resulting mixture was stirred. Subsequently, the mixture was heated to 40° C., and said Sodium Chloride Solution G and 6.00 kg of isopropanol (manufactured by Kanto Kagaku Co.), and said Nonionic Surface Active Agent Solution G were added in said order. Thereafter, the resulting mixture was put aside for 10 minutes, and then heated to 85° C. over a period of 60 minutes. While being heated at 85±2° C. for the period of from 0.5 to 3 hours while stirring, the mixture was subjected to salting-out/fusion so that the particle diameter increased. Subsequently, the increase in the particle diameter was terminated by the addition of 2.1 liters of pure water.

Charged into a 5 liter reaction vessel (the reaction apparatus constituted as shown in FIG. 9, having a crossed axes angle $\alpha$ of 20 degrees), fitted with a thermal sensor, a cooling pipe, and a particle diameter and shape monitoring device, were 5.0 kg of the coalesced particle dispersion as prepared above, and said dispersion was heated at 85±2° C. for a period of from 0.5 to 15 hours so as to control the particle shape. Thereafter, the resulting dispersion was cooled to no more than 40° C. and stirring was terminated. Subsequently, while employing a centrifuge, classification was carried out in the liquid medium utilizing a centrifugal sedimentation method, and filtration was carried out employing a 45 $\mu$m sieve. The resulting filtrate was designated as Coalesced Liquid. Subsequently, wet cake-like non-spherical particles were collected from said Coalesced Liquid through filtration employing a Buchner's funnel, and then washed with deionized water. The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method.

Toners Bk1 through Bk5 shown in Table 1 were obtained by controlling the shape as well as the variation coefficient of the shape coefficient through controlling the rotation frequency of the stirrer as well as the heating time during said salting-out/fusion stage and the monitoring of the shape controlling process, and further regulating the particle diameter and the variation coefficient of the size distribution.

Toner Production Example 2

Example of Emulsion Polymerization Method

Yellow toners Y1 through Y5, having same shape characteristics and particle size distribution characteristics, were obtained by the same way as Toner Production Example 1 except that 1.05 kg of C.I. Pigment Yellow 180 was employed in place of the carbon black as a colorant.

Toner Production Example 3

Example of Emulsion Polymerization Method

Magenta toners M1 through M5, having same shape characteristics and particle size distribution characteristics, were obtained by the same way as Toner Production Example 1 except that 1.20 kg of C.I. Pigment Red 122, a quinacridone magenta pigment, was employed in place of the carbon black as a colorant.

Toner Production Example 4

Example of Emulsion Polymerization Method

Cyan toners C1 through C5, having same shape characteristics and particle size distribution characteristics, were obtained by the same way as Toner Production Example 1 except that 0.60 kg of C.I. Pigment Blue 15:3, a phthalocyanine cyan pigment, was employed in place of the carbon black as a colorant.

Toner Production Example 5

Example of Suspension Polymerization Method

A mixture consisting of 165 g of styrene, 35 g of n-butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushuki Kako Kogyo Co.). Added to the resulting dispersion were 10 g of 2,2'-azobis(2,4-valeronitile) as the polymerization initiator and dissolved to prepare a polymerizable monomer composition. Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion in which tricalcium phosphate was prepared. Said polymerizable monomer composition was added to said dispersion and stirred at 10,000 rpm for 20 minutes employing a TK Homomixer, whereby said polymerizable monomer composition was granulated. Thereafter, the resulting composition underwent reaction at a temperature of from 75 to 95° C. for a period of from 5 to 15 hours, employing a reaction apparatus (having a crossed axes angle $\alpha$ of 45 degrees) in which stirring blades were constituted as shown in FIG. 2. Tricalcium phosphate was dissolved employing hydrochloric acid and then removed. Subsequently, while employing a centrifuge, classification was carried out in a liquid medium utilizing a centrifugal sedimentation method. Thereafter, filtration, washing and drying were carried out. Externally added to 100 parts by weight of the obtained colored particles were 1.0 part by weight of fine silica particles and 0.1 part by weight of zinc stearate, and the resulting mixture was blended employing a Henschel mixer, whereby a toner was obtained which was prepared employing the suspension polymerization method.

Black Toners Bk6 through Bk8 were obtained by controlling the shape as well as the variation coefficient of the shape coefficient through controlling the temperature of the liquid medium, the rotation frequency of the stirrer, and the heating duration while carrying out monitoring during said polymerization and further regulating the particle diameter as well as the variation coefficient of the size distribution.

Toner Production Example 6

Example of Suspension Polymerization Method

Yellow toners Y6 through Y8, having same shape characteristics and particle size distribution characteristics, were obtained by the same way as Toner Production Example 5 except that 1.05 kg of C.I. Pigment Yellow 180 was employed in place of the carbon black as a colorant.

Toner Production Example 7

Example of Suspension Polymerization Method

Magenta toners M6 through M8, having same shape characteristics and particle size distribution characteristics, were obtained by the same way as Toner Production Example 5 except that 1.20 kg of C.I. Pigment Red 122, a quinacridone magenta pigment, was employed in place of the carbon black as a colorant.

Toner Production Example 8

Example of Suspension Polymerization Method

Cyan toners C6 through C8, having same shape characteristics and particle size distribution characteristics, were obtained by the same way as Toner Production Example 5 except that 0.60 kg of C.I. Pigment Blue 15:3, a phthalocyanine cyan pigment, was employed in place of the carbon black as a colorant.

Toner Production Example 9

Example of a Suspension Polymerization Method

Black toner 9 having specific shape coefficient and particle size distribution characteristics as described in Table 1 in the similar manner to Preparation Example 5 excepted that reaction vessel as shown by FIG. 9 having crossed axis $\alpha$ of 15° and classification by a centrifuge in liquid was omitted.

Toner Production Example 10

Example of Suspension Polymerization Method

Yellow toner Y9, having same shape characteristics and particle size distribution characteristics, were obtained by the same way as Toner Production Example 9 except that 1.05 kg of C.I. Pigment Yellow 180 was employed in place of the carbon black as a colorant.

Toner Production Example 11

Example of Suspension Polymerization Method

Magenta toner M9, having same shape characteristics and particle size distribution characteristics, were obtained by the same way as Toner Production Example 9 except that 1.20 kg of C.I. Pigment Red 122, a quinacridone magenta pigment, was employed in place of the carbon black as a colorant.

Toner Production Example 12

Example of Suspension Polymerization Method

Cyan toner C9, having same shape characteristics and particle size distribution characteristics, were obtained by the same way as Toner Production Example 9 except that 0.60 kg of C.I. Pigment Blue 15:3, a phthalocyanine cyan pigment, was employed in place of the carbon black as a colorant.

Toner Production Example 10

Example of a Pulverization Method

Toner raw materials comprised of 100 kg of a styrene-n-butyl acrylate copolymer resin, 10 kg of carbon black, and 4 weight parts of polypropylene were preliminary mixed employing a Henschel mixer, and the resulting mixture was fuse-kneaded employing a biaxial extruder, preliminary pulverized employing a hammer mill, and further pulverized employing a jet method pulverizing unit. The resulting powder was dispersed (for 0.05 second at 200 to 300° C.) into the heated air flow of a spray drier to obtain shape adjusted particles. The resulting particles were repeatedly classified employing a forced air classifying unit until the targeted particle diameter distribution was obtained. Externally added to 100 weight parts of the obtained colored particles was one part of fine silica particles and mixed employing a Henschel mixer. Thus black toner Bk10, prepared employing the pulverization method, was obtained.

The shape as well as the variation coefficient of the shape coefficient was modified, and further, the particle diameter as well as the variation coefficient of the particle size distribution was controlled. Thus black toner Bk10 and Bk11 were prepared.

Toner Production Example 14

Example of a Pulverization Method

Yellow toners Y10 and Y11 were obtained by employing 1.05 kg of C.I. Pigment Yellow 185 in place of carbon black in Preparation Example 13.

Toner Production Example 14

Example of a Pulverization Method

Magenta toners M10 and M11 were obtained by employing 1.20 kg of a quinacridone magenta pigment C.I. Pigment Red 122 in place of carbon black in Preparation Example 13.

Toner Production Example 15

Example of a Pulverization Method

Cyan toner C10 and C11 were obtained by employing 0.60 kg of a phthalocyanine pigment C.I. Pigment Blue 15:3 in place of carbon black in Preparation Example 13.

Shape characteristics and so on are listed in the following Table 1.

TABLE 1

| Toner No. | Shape Coefficient Ratio | Variation Coefficient the Shape Coefficient (%) | Shape Coefficient Ratio of 1.0 to 1.6 (in %) | Ratio of Toner Particles Without Corners (in %) | Number Average Particle Diameter (in $\mu$m) | Sum M of $m_1$ and $m_2$ (in %) | Variation Coefficient of Particle Number Distribution (in %) |
|---|---|---|---|---|---|---|---|
| Bk1 | 1.54 | 13 | 86 | 85 | 5.3 | 72 | 25 |
| Y1 | 1.46 | 14 | 82 | 82 | 5.2 | 74 | 24 |
| M1 | 1.48 | 12 | 89 | 83 | 5.4 | 78 | 25 |
| C1 | 1.49 | 11 | 88 | 87 | 5.3 | 72 | 23 |
| Bk2 | 1.47 | 11 | 88 | 88 | 5.9 | 76 | 21 |
| Y2 | 1.43 | 12 | 88 | 88 | 5.9 | 78 | 20 |
| M2 | 1.44 | 13 | 89 | 89 | 5.8 | 75 | 21 |
| C2 | 1.41 | 10 | 90 | 88 | 5.9 | 75 | 21 |
| Bk3 | 1.37 | 14 | 79 | 78 | 5.2 | 72 | 23 |
| Y3 | 1.33 | 14 | 78 | 78 | 5.1 | 71 | 21 |
| M3 | 1.34 | 13 | 79 | 79 | 5 | 74 | 22 |
| C3 | 1.31 | 13 | 78 | 78 | 5.3 | 73 | 23 |
| Bk4 | 1.27 | 11 | 89 | 93 | 5.4 | 75 | 22 |
| Y4 | 1.29 | 11 | 87 | 92 | 5.7 | 75 | 21 |
| M4 | 1.28 | 12 | 89 | 91 | 5.5 | 76 | 21 |
| C4 | 1.28 | 11 | 88 | 93 | 5.5 | 76 | 20 |
| Bk5 | 1.10 | 10 | 59 | 94 | 5.3 | 62 | 32 |
| Y5 | 1.15 | 13 | 57 | 97 | 5.3 | 62 | 32 |
| M5 | 1.12 | 11 | 58 | 98 | 5.5 | 61 | 31 |
| C5 | 1.14 | 9 | 56 | 95 | 5.5 | 64 | 34 |
| Bk6 | 1.79 | 20 | 52 | 74 | 6.3 | 72 | 29 |
| Y6 | 1.78 | 21 | 53 | 77 | 6.8 | 72 | 28 |
| M6 | 1.76 | 21 | 54 | 75 | 5.3 | 71 | 33 |
| C6 | 1.81 | 19 | 55 | 74 | 5.6 | 74 | 28 |
| Bk7 | 1.31 | 12 | 69 | 89 | 5.6 | 79 | 18 |
| Y7 | 1.32 | 11 | 68 | 90 | 5.6 | 78 | 18 |
| M7 | 1.31 | 12 | 67 | 91 | 5.6 | 79 | 19 |

TABLE 1-continued

| Toner No. | Shape Co-efficient Ratio | Variation Coefficient the Shape Coefficient (%) | Shape Co-efficient Ratio of 1.0 to 1.6 (in %) | Ratio of Toner Particles Without Corners (in %) | Number Average Particle Diameter (in μm) | Sum M of $m_1$ and $m_2$ (in %) | Variation Coefficient of Particle Number Distribution (in %) |
|---|---|---|---|---|---|---|---|
| C7 | 1.31 | 13 | 69 | 90 | 5.8 | 79 | 19 |
| Bk8 | 1.16 | 18 | 44 | 92 | 5.7 | 80 | 28 |
| Y8 | 1.16 | 19 | 45 | 92 | 5.7 | 81 | 31 |
| M8 | 1.17 | 17 | 46 | 93 | 5.5 | 83 | 33 |
| C8 | 1.13 | 25 | 46 | 96 | 5.7 | 84 | 38 |
| 2k9 | 1.31 | 11 | 71 | 90 | 5.6 | 76 | 20 |
| Y9 | 1.32 | 12 | 70 | 91 | 5.6 | 77 | 22 |
| M9 | 1.32 | 13 | 72 | 92 | 5.6 | 79 | 23 |
| C9 | 1.31 | 13 | 73 | 91 | 5.8 | 78 | 21 |
| Bk10 | 1.54 | 14 | 83 | 52 | 5.9 | 79 | 18 |
| Yb | 1.52 | 14 | 82 | 54 | 5.5 | 78 | 18 |
| M10 | 1.52 | 12 | 83 | 51 | 5.7 | 79 | 17 |
| C10 | 1.53 | 13 | 83 | 50 | 5.9 | 79 | 19 |
| Bk11 | 1.58 | 19 | 73 | 47 | 5.6 | 63 | 36 |
| Y11 | 1.61 | 25 | 72 | 43 | 5.4 | 64 | 33 |
| M11 | 1.57 | 17 | 73 | 41 | 5.4 | 63 | 35 |
| C11 | 1.52 | 20 | 73 | 45 | 5.3 | 65 | 36 |

Said toners were blended with a silicone resin coated ferrite carrier having a volume average particle diameter of 60 μm, and Developers 1 through 15 corresponding to the toners 1 through 15 having a toner concentration of 6 percent was prepared.

Characteristics of the developers 1 through 15 are shown in Table 2.

TABLE 2

| Developer | Combination of Toners | R1 | R2 | R3 | R4 |
|---|---|---|---|---|---|
| 1 | Bk1/Y1/M1/C1 | 0.051 | 0.21 | 0.037 | 0.080 |
| 2 | Bk2/Y2/M2/C2 | 0.041 | 0.15 | 0.017 | 0.048 |
| 3 | Bk3/Y3/M3/C3 | 0.044 | 0.07 | 0.057 | 0.087 |
| 4 | Bk4/Y4/M4/C4 | 0.016 | 0.08 | 0.053 | 0.091 |
| 5 | Bk5/Y5/M5/C5 | 0.043 | 0.33 | 0.037 | 0.059 |
| 6 | Bk6/Y6/M6/C6 | 0.028 | 0.10 | 0.221 | 0.152 |
| 7 | Bk7/Y7/M7/C7 | 0.008 | 0.15 | 0.034 | 0.053 |
| 8 | Bk8/YB/M8/C8 | 0.034 | 0.32 | 0.035 | 0.263 |
| 9 | Bk9/Y9/M9/C9 | 0.008 | 0.15 | 0.034 | 0.130 |
| 10 | Bk10/Y10/M10/C10 | 0.013 | 0.14 | 0.034 | 0.105 |
| 11 | Bk11/Y11/M11/C11 | 0.056 | 0.32 | 0.054 | 0.083 |
| 12 | Bk1/Y2/M3/C4 | 0.169 | 0.15 | 0.102 | 0.200 |
| 13 | Bk2/Y2/M3/C4 | 0.129 | 0.15 | 0.102 | 0.091 |
| 14 | 2k3/Y2/M2/C3 | 0.069 | 0.14 | 0.119 | 0.130 |
| 15 | Bk8/Y8/M11/C11 | 0.261 | 0.15 | 0.070 | 0.222 |

The prepared toners were tested by employing a digital color copying machine shown in FIG. 12, wherein a contacting-pressure type heat fixing member shown in FIG. 13 was employed. The contacting-pressure type heat fixing member is detailed below.

The fixing member comprises an upper roller composed of a cylindrical aluminum alloy tube of 30 mm inner diameter and 310 mm width having a thickness of 0.8 mm and including a heater at the center, the surface of which is covered with a sponge silicone rubber having Ascar C hardness of 30 and thickness of 8 mm, and a lower roller composed of a cylindrical iron tube of 40 mm inner diameter having a thickness of 2.0 mm covered with silicone rubber sponge having Ascar C hardness of 30 and thickness of 2 mm. The nip width was set at 5.8 mm. Employing this fixing member, the printing line speed was set at 180 mm/second. The surface of the heating roller was covered with PFA tube having thickness of 50 μm.

Further, employed as the cleaning mechanism of the fixing device was a supply method employing a web method in which polydiphenylsilicone (having a viscosity of 10 Pa s at 20° C.) was impregnated.

The fixing temperature was controlled by regulating the surface temperature of the upper roller, the temperature of which was set at 175° C. Coating amount of silicone oil was set as 0.6 mg per A4 size sheet.

Color difference each of the first copy and 100,000th copy was measured. The measurement was conducted in the following method.

The secondary colors (red, blue, and green) of the solid image portion in each of images formed on the first sheet and 20,000th sheet were measured by a "Macbeth Color-Eye 7000", and the color difference was calculated employing a CMC (2:1) color difference formula.

When the color difference obtained by the CMC (2:1) color difference formula was not more than 5, the variation of hue of the formed images was judged to be within the tolerance range.

Definition of line image formed by toner dots each of four colors was compared so as to evaluate the smoothness of image after transfer and fixing process. The definition was number of lines per mm of line image perpendicular to the direction of development recognized through a magnifier of 10 magnification.

The result is summarized in Table 3.

TABLE 3

| Sample No. | Developer No. | Color Difference Initial | Color Difference 100,000 th | Definition (lines/mm) Initial | Definition (lines/mm) 100,000 th |
|---|---|---|---|---|---|
| 1 | 1 | 1 | 2 | 7 | 7 |
| 2 | 2 | 1 | 2 | 7 | 7 |
| 3 | 3 | 1 | 3 | 7 | 7 |
| 4 | 4 | 2 | 3 | 7 | 6 |
| 5 | 7 | 1 | 2 | 7 | 7 |
| 6 | 9 | 2 | 2 | 7 | 7 |
| 7 | 10 | 3 | 5 | 7 | 6 |
| 8 | 12 | 1 | 1 | 7 | 7 |
| 9 | 13 | 2 | 3 | 7 | 7 |

TABLE 3-continued

| Sample No. | Developer No. | Color Difference Initial | Color Difference 100,000 th | Definition (lines/mm) Initial | Definition (lines/mm) 100,000 th |
|---|---|---|---|---|---|
| 10 | 14 | 2 | 3 | 7 | 7 |
| 11 | 5 | 4 | 8 | 6 | 5 |
| 12 | 6 | 5 | 9 | 5 | 3 |
| 13 | 8 | 4 | 7 | 6 | 4 |
| 14 | 11 | 5 | 8 | 6 | 5 |
| 15 | 15 | 5 | 9 | 6 | 3 |

Samples from 1 to 10 show low color difference and good image definition in both of initial and 100,000th copy.

What is claimed is:

1. An image forming method comprising the steps of forming a latent image on an image carrying member, developing the latent image by a developer containing a toner, transferring the toner image onto an intermediate transfer member, transferring the toner image transferred on the intermediate transfer member onto an image forming support, and fixing the toner image formed on the image forming support, wherein the toner comprises toner particles and has a variation coefficient of the shape coefficient of not more than 16% and a number variation coefficient of the particle size distribution of not more than 27%.

2. The image forming method of claim 1 wherein not less than 65% in number of the toner particles comprise a shape coefficient of from 1.0 to 1.6.

3. The image forming method of claim 1 wherein not less than 50% of the toner particles comprise no corner.

4. The image forming method of claim 1 wherein not less than 65% in number of the toner particles having a shape coefficient of from 1.2 to 1.6.

5. The image forming method of claim 1 wherein the toner comprises toner particles included in the highest frequency class at least 70 percent of the sum(M) of the relative frequency($m_1$) of the toner particles, and the relative frequency(m2) of the toner particles included in the second highest frequency class in a number-based histogram, in which natural logarithm InD is taken as the abscissa and said abscissa is divided into plurality of classes at an interval of 0.23, wherein D is diameter of toner particles.

6. The image forming method of claim 1 wherein the toner particles having a shape coefficient within the range of from 1.2 to 1.6 in a ratio of not less than 70%.

7. The image forming method of claim 1 wherein the intermediate transferring member comprises a pipe shaped electroconductive shaft and a resistive elastic layer.

8. The image forming method of claim 1 comprising cleaning the intermediate transferring member after one or more of the toner images necessary to form an image are transferred onto the image forming support.

9. An image forming method comprising:

forming an image on a latent image carrying member;

developing the latent image by a developer containing a toner to form a toner image;

transferring the toner image onto an intermediate transfer member;

transferring the toner image transferred on the intermediate transfer member onto an image forming support; and fixing the toner image formed on the image forming support, wherein the toner contains toner particles having no corner in a ratio of not less than 50% and the number variation coefficient of the particles diameter distribution in number being not more than 27%.

10. The image forming method of claim 9, wherein the steps a) to c) are repeated and each latent images is developed by developers containing different color of toners.

11. An image forming method comprising:

developing a latent image on an image carrying member by a developer containing a toner to form a toner image;

transferring the toner image on an intermediate transfer member;

transferring the toner image on the intermediate transfer member to an image forming support; and fixing the toner image transferred on the image forming support, wherein the toner has a ratio of toner particles having a shape coefficient of from 1.2 to 1.6 of not less than 65% in number and a variation coefficient of the shape coefficient of not more than 16%.

12. The image forming method of claim 3, wherein not less than 65% in number of the toner particles has a shape coefficient of from 1.2 to 1.6.

13. The image forming method of claim 12, wherein the toner has a number average diameter of the toner particles from 3 to 8 $\mu$m.

14. The image forming method of claim 13, wherein the variation coefficient of the shape coefficient is not more than 14% and the number variation coefficient of the particle size distribution is not more than 25%.

15. The image forming method of claim 1, wherein the variation coefficient of the shape coefficient is not more than 14% and the number variation coefficient of the particle size distribution is not more than 25%.

16. The image forming method of claim 7, wherein an intrinsic volume resistively of the elastic layer of the intermediate transfer member is 10 times or more of that of an elastic layer of an transfer roller utilized in the step of transferring the toner image to the image forming support.

17. The image forming method of claim 1, wherein the toner has a number average diameter of the toner particles from 3 to 8 $\mu$m.

18. The image forming method of claim 1, wherein the steps of forming, developing and transferring the toner image to the intermediate transfer member are repeated, and each latent image is developed by developers containing different color of toners.

19. The image forming method of claim 9, wherein the toner has the number variation coefficient of the particles diameter distribution is not more than 25% and the ratio of the toner particles having no corner is at least 70%.

20. The image forming method of claim 19, wherein not less than 65% in number of the toner particles has a shape coefficient of from 1.0 to 1.6.

21. The image forming method of claim 20, wherein the toner has a number average diameter of the toner particles from 3 to 8 $\mu$m.

22. The image forming method of claim 9, wherein-the toner comprises toner particles included in the highest frequency class at least 70 percent of the sum(M) of the relative frequency($m_1$) of the toner particles, and the relative frequency($m_2$) of the toner particles included in the second highest frequency class in a number based histogram, in which natural logarithm InD is taken as the abscissa and said abscissa is divided into a plurality of classes at an interval of 0.23, wherein D is diameter of toner particles.

23. The image forming method of claim 9, wherein the intermediate transferring member comprises a pipe shaped electroconductive shaft and a resistive elastic layer.

24. The image forming method of claim 23, wherein the intrinsic volume resistively of the elastic layer of the intermediate transfer member is 10 times or more of that of an elastic layer of an transfer roller utilized in- the step of transferring the toner image to the image forming support.

25. The image forming method of claim 9, wherein not less than 65% in number of the toner particles has a shape coefficient of from 1.2 to 1.6.

26. The image forming method of claim 11, wherein the steps of forming, developing and transferring the toner image to the intermediate transfer member are repeated, and each latent image is developed by developers containing different color of toners.

27. The image forming method of claim 11, wherein the toner has a number variation coefficient of the particle size distribution is not more than 25% and a ratio of the toner particles having no corner being at least 70%.

28. The image forming method of claim 27, wherein the toner has a number average diameter of the toner particles from 3 to 8 $\mu$m.

29. The image forming method of claim 11, wherein the toner comprises toner particles included in the highest frequency class at least 70 percent of the sum(M) of the relative frequency($m_1$) of the toner particles, and the relative frequency($m_2$) of the toner particles included in the second highest frequency class in a number based histogram, in which natural logarithm InD is taken as the abscissa and said abscissa is divided into a plurality of classes at an interval of 0.23, wherein D is diameter of toner particles.

30. The image forming method of claim 11, wherein the intermediate transferring member comprises a pipe shaped electroconductive shaft and a resistive elastic layer.

31. The image forming method of claim 30, wherein the Intrinsic volume resistively of the elastic layer of the intermediate transfer member is 10 times or more of that of an elastic layer of an transfer roller, utilized in the step of transferring the toner image to the image forming support.

32. The image forming method of claim 11, wherein the toner has a number average diameter of the toner particles from 3 to 8 $\mu$m.

33. The image forming method of claim 11, wherein the variation coefficient of the shape coefficient is not more than 14% and the toner has a number variation coefficient of the particle size distribution is not more than 25%.

* * * * *